US007221336B2

(12) United States Patent
Moon

(10) Patent No.: US 7,221,336 B2
(45) Date of Patent: May 22, 2007

(54) AGING DRIVING APPARATUS OF FIELD EMISSION DISPLAY DEVICE AND DRIVING METHOD

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 548 days.

(21) Appl. No.: 10/751,956

(22) Filed: Jan. 7, 2004

(65) Prior Publication Data

US 2004/0207575 A1 Oct. 21, 2004

(30) Foreign Application Priority Data

Apr. 18, 2003 (KR) ..... 10-2003-0024759

(51) Int. Cl.
*G09G 3/20* (2006.01)

(52) U.S. Cl. ..... 345/75.2; 445/24

(58) Field of Classification Search ..... 345/75.2, 345/65, 691, 204, 75.1, 74.1
See application file for complete search history.

(56) References Cited

U.S. PATENT DOCUMENTS 5,594,305 A * 1/1997 Primm et al. ..... 315/169.3
6,060,840 A * 5/2000 Foo et al. ..... 315/169.1
6,204,834 B1 * 3/2001 Baker et al. ..... 345/75.2
6,225,749 B1 * 5/2001 Kobayashi et al. ..... 315/169.3
6,404,136 B1 * 6/2002 Murray et al. ..... 315/169.1
6,621,228 B2 * 9/2003 Harada et al. ..... 315/169.3

* cited by examiner

*Primary Examiner*—Amr A. Awad
*Assistant Examiner*—Michael Pervan
(74) *Attorney, Agent, or Firm*—Ked & Associates, LLP

(57) ABSTRACT

An aging driving method of a field emission display device can secure long lifetimes of panel by reducing possibilities of generation of arcing, by largely increasing energy distribution under a low voltage, and by applying a pulse voltage which is varied to reduce energy distribution under a high voltage as time goes, in aging processing. In addition, aging is performed in a very short time by using small energy in a pulse supply, thereby preventing a damage of a panel and much shortening an aging time. In addition, aging is performed in each pre-aging process and a main-aging process, to reduce contaminants, thereby lengthening lifetimes of a panel and securing reliability of a product.

20 Claims, 3 Drawing Sheets

AGING DRIVING APPARATUS OF FIELD EMISSION DISPLAY DEVICE AND DRIVING METHOD

BACKGROUND OF THE INVENTION

1. Field of the Invention

The present invention relates to a field emission display (FED) device, and particularly, to an aging driving apparatus of a field emission display device and a driving method capable of preventing arcing by varying and applying a pulse over time in aging processing.

2. Description of the Background Art

In general, as an information processing system develops and is increasingly diffused, a display apparatus as a means for transmitting visual information is being importantly considered.

As a conventional display device, a CRT (Cathode Ray Tube) is disadvantageous in that it has a large volume and that an image display is distorted by an earth magnetic field.

Recent various display devices are aimed to have a large screen, a flat screen, a high brightness and high efficiency of a screen. Accordingly, studies of various flat panel display devices are actively proceeding. For example, as the flat panel display device, a liquid crystal display (referred to as "LCD) device, a plasma display panel (referred to as "PDP) device, a field emission display (referred to as "FED") device and the like are developing.

Recently, wireless mobile communication such as IMT-2000 has been limelighted. A display device used for such wireless mobile communication requires a high speed, a low weight and small power consumption or the like. AS a representative switching device which can satisfy such requirements, there may be an MIM (Metal-Insulator-Metal).

In general, an MIM FED (Field Emission Display) device has a high-vacuum region for emitting an electron between an upper plate and a lower plate to which a high voltage is applied, that is, at a region between an anode and a cathode.

However, when a FED vacuum tube is manufactured to construct the high-vacuum region, a small amount of contaminants can be generated on surfaces such as emission elements, faceplates, gate electrodes, spacer walls or the like. Accordingly, when a field emission display device containing the contaminants is driven, electrons bombard the contaminants, and thus particles of the contaminants are knocked off from the surface.

Accordingly, when such phenomenon occurs, a high ionization pressure region is formed in a vacuum tube and thus emission of electrons is accelerated between a scan electrode and a gate electrode, and part of the emitted electrons is not emitted to an anode, but collides against the gate electrode, thereby overheating the gate electrode or having a bad effect upon forming a voltage difference between the gate electrode and an emitter electrode. Thus, when the gate electrode is overheated, a brightness discharge current beyond an energy gap between the emitter electrode and the gate electrode is formed, thereby causing a serious damage to the scan electrode and thus causing shortening of lifetimes of the field emission display device. Such a phenomenon is called arcing.

In order to prevent the arcing from occurring, contaminants in a panel should be removed and pressure in the panel should be lowered (that is, maintaining high vacuum).

As a method for removing contaminants of the conventional field discharge device in order to solve such problems, a getter which can absorb contaminants is included in a panel so as to absorb contaminants in driving of the field emission display device.

However, the method of absorbing contaminants by using the getter is disadvantageous in that a special process is needed. In addition, capacity of a getter is greatly different according to the size of a field emission display device, and in a state of reaching uppermost limit (that is, saturation), contaminants can no more absorbed.

In order to solve the problems generated in a use of the above-mentioned getter, recently, contaminants in a high-vacuum region are removed by an aging method using a DC voltage.

FIG. 1 is a graph illustrating a high voltage applied to an anode electrode over aging time according to the conventional art.

As shown in FIG. 1, for the conventional aging method, a method of separating contaminants attached to a surface of a high-vacuum region by applying a DC high voltage to an anode is used.

However, due to a DC voltage which gradually increases in the field emission display device, very high energy is charged in the field emission display device as time goes, and arcing frequently occurs due to a high field, thereby damaging the device and thus shortening lifetimes thereof.

SUMMARY OF THE INVENTION

Therefore, an object of the present invention is to provide an aging driving apparatus of a field emission display device and a driving method capable of preventing arcing from occurring in advance or reducing possibility of arcing and reducing entire consumption of energy, by converting a DC high voltage inputted to an anode electrode into a high voltage having a pulse form, varying a width of the pulse signal over time and applying the pulse signal to the anode electrode, that is by performing aging by using low energy.

To achieve these and other advantages and in accordance with the purpose of the present invention, as embodied and broadly described herein, there is provided an aging apparatus of a field emission display device which is provided with a scan driving unit and a panel, including an aging-driving controlling unit which performs aging by applying a high voltage having a pulse form whose width is varied over time, to an anode electrode of the panel.

To achieve these and other advantages and in accordance with the purpose of the present invention, as embodied and broadly described herein, there is provided an aging driving method of a field emission display device which is provided with a scan driving unit and a panel, including performing pre-aging that a high voltage having a pulse form whose width is varied by switching a DC high voltage applied to an anode of the panel is outputted.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a preferred embodiment of an aging driving method of a field emission display device capable of preventing arcing and reducing entire consumption of energy, by applying a pulse voltage whose width is varied, to an anode electrode.

Figure 1:
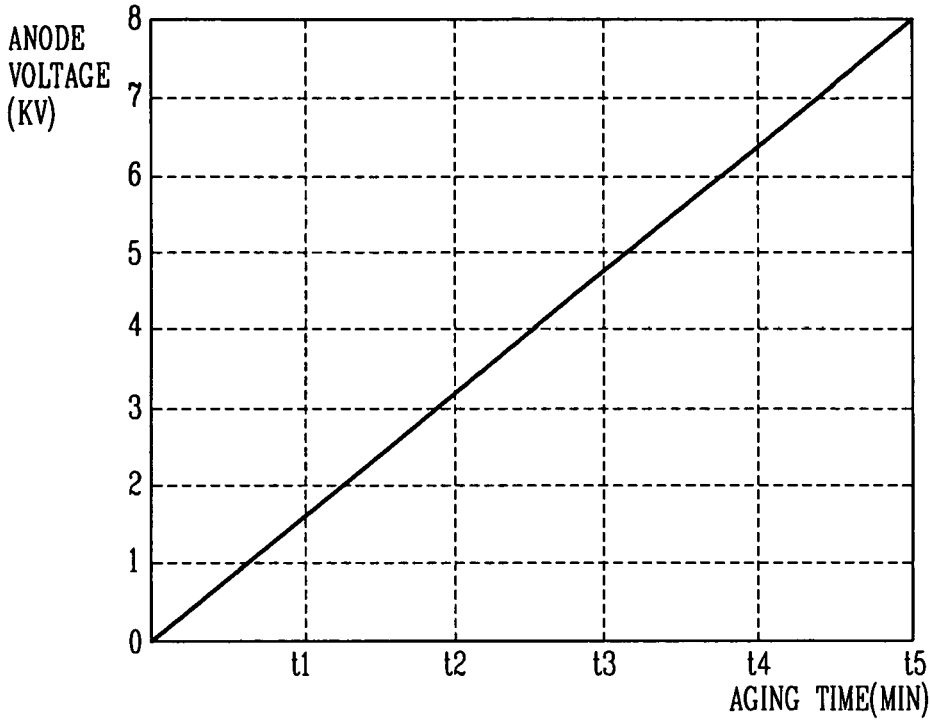
FIG. 1 RELATED ART
FIG. 1 is a graph illustrating a high voltage applied to an anode electrode over aging time according to the conventional art.
Figure 2:
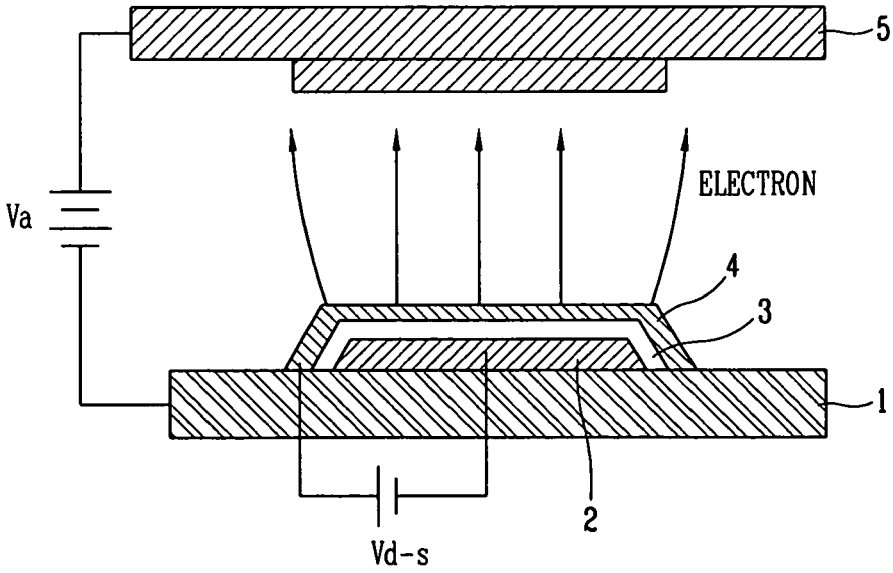
FIG. 2 is a schematic sectional view of a field emission display device for performing aging according to the present invention.

FIG. 2 is a schematic sectional view of a field emission display device for performing aging according to the present invention.

As shown in FIG. 2, in a field emission display device according to the present invention, a scan electrode 2, an insulating layer 3 and a data electrode 4 are sequentially laminated at an upper portion of a lower substrate glass 1, and an anode electrode 5 which is isolated from and opposite the data electrode 4 is positioned. At this time, a region between the data electrode 4 and the anode electrode 5 is in a high-vacuum state, and the high-vacuum state is not a state of being sealed but a state that high vacuum is maintained by a vacuum pump.

Simple operations of the field emission display device constructed as above will now be described.

First, when a certain voltage (Vd-s) is applied to a data electrode 4 and a scan electrode 2, a electron is emitted from the scan electrode 2, and the electron is emitted via the insulating layer 3 and the data electrode 4 by quantum mechanical tunnel effect. At this time, the certain voltage (Vd-s) controls strength of an electron. Accordingly, when a voltage (Vd-s) is high, the amount of electrons emitted form the scan electrode 2 is increased, and when a voltage (Vd-s) is low, the amount of emitted electrons is decreased.

Thereafter, the emitted electrons are moved accelerated toward an anode where fluorescent substances are applied, by a higher anode voltage (Va). When the electrons collide against the fluorescent substances, energy is generated, and by this energy, electrons of the fluorescent substances are excited and then knocked off, emitting light.

Figure 3:
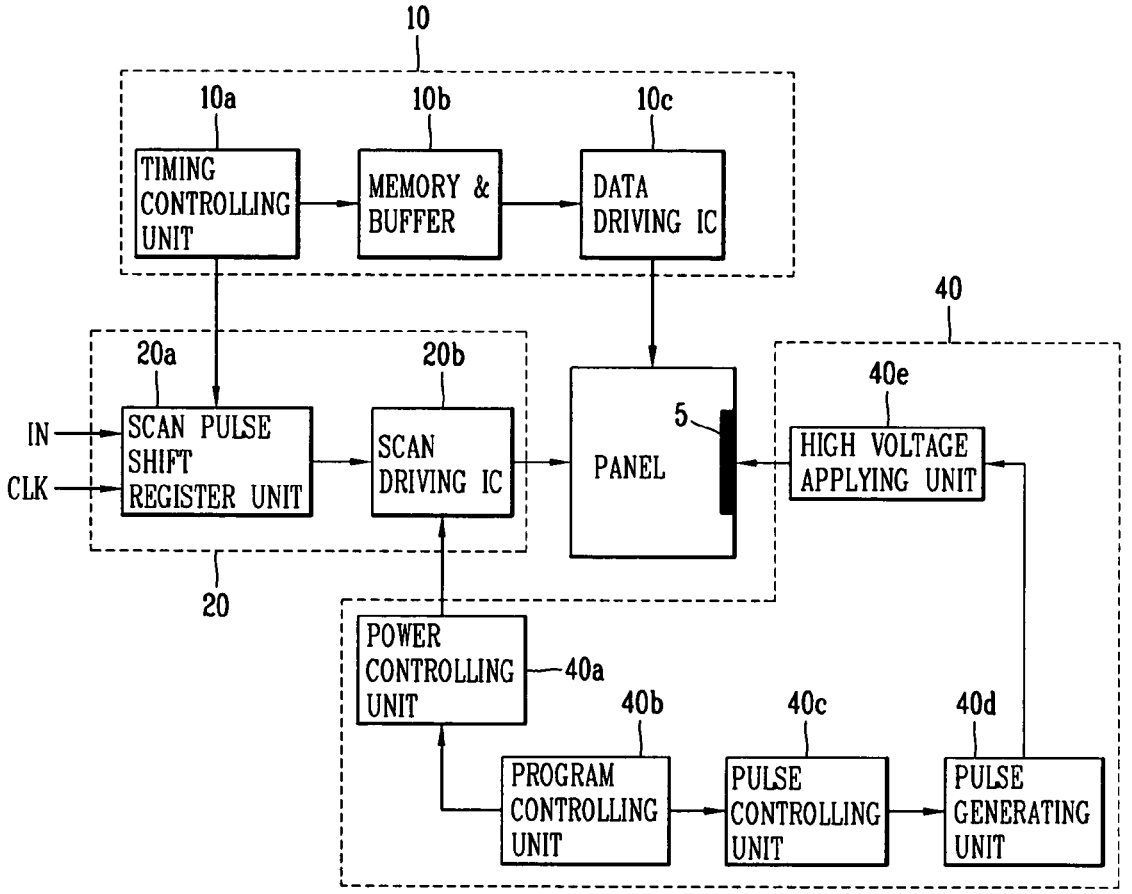
FIG. 3 is a block diagram illustrating a structure of an aging driving apparatus of a field emission display device according to the present invention.

FIG. 3 is a block diagram illustrating a structure of an aging driving apparatus of a field emission display device according to the present invention.

As shown in FIG. 3, an aging driving apparatus of the field emission display device includes a data driving unit 10 for outputting a timing controlling signal and a data pulse; a scan driving unit 20 receiving a data signal and a CLK signal which are inputted from the outside by the timing controlling signal outputted at the data driving unit 10, and outputting a scan pulse; a panel 30 receiving the data pulse outputted from the data driving unit 10 and the scan pulse outputted from the scan driving unit 20, and displaying data; and an aging-driving controlling unit 40 controlling a high voltage having a pulse form applied to the anode electrode 5 of the panel 30 and a voltage applied to the scan driving unit 20, to perform aging.

An aging driving apparatus of the field emission display device will now be described in detail.

The data driving unit 10 includes a timing controlling unit 10*a*, a memory & buffer 10*b*, and a data driving IC 10*c*.

The scan driving unit 20 includes a scan pulse shift register unit 20*a* and a scan driving IC 20*b*.

The aging driving controlling unit 40 includes a power controlling unit 40*a* for applying power to the scan driving unit 20 by an external power controlling signal; a pulse controlling unit 40*c* receiving an external program controlling signal, and outputting a pulse controlling signal corresponding to a frequency and duty cycle which are varied over time; a pulse generating unit 40*d* receiving the pulse controlling signal outputted from the pulse controlling unit 40*c*, and outputting a corresponding pulse signal; a high voltage applying unit 40*e* receiving the pulse signal from the pulse generating unit 40*d*, converting the received pulse signal into a high voltage having a pulse form (that is, AC high voltage) and then applying the high voltage having a pulse form to the anode electrode 5; and a program controlling unit 40*b* outputting a program controlling signal to the pulse controlling unit 40*c*, and outputting a power controlling signal to the power controlling unit 40*a*. Herein, the program controlling unit 40*b* and the power controlling unit 40*a*, the program controlling unit 40*b* and the pulse generating unit 40*c*, and the program controlling unit 40*b* and the high voltage applying unit 50*d* are interconnected by a general purpose interface bus (GPIB) (e.g., Hewlett-Packard Interface bus (HPIB).

Figure 4:
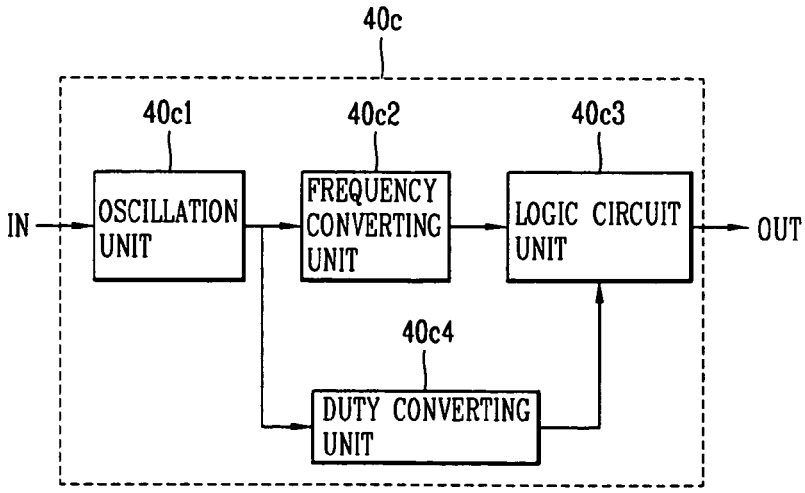
FIG. 4 is a block diagram illustrating a pulse controlling unit in detail according to the present invention.

FIG. 4 is a block diagram illustrating a pulse controlling unit according to the present invention in detail.

As shown in FIG. 4, the pulse controlling unit 40*c* includes an oscillation unit 40*c*1 receiving a program controlling signal from the program controlling unit 40*b*, and outputting a predetermined frequency; a frequency converting unit 40*c*2 receiving the predetermined frequency from the oscillation unit 40*c*1, and converting and outputting the frequency; a duty converting unit 40*c*4 receiving a program controlling signal from the program controlling unit 40*b*, and outputting a corresponding duty cycle; a logic circuit unit 40*c*3 receiving the converted frequency from the frequency converting unit 40*c*2 and the duty cycle from the duty converting unit 40*c*4, and outputting a pulse controlling signal to the pulse generating unit 40*d*.

In addition, the high voltage applying unit 40*e* receives a pulse signal from the pulse generating unit, to perform a switching operation. In order to perform the switching operation, the high voltage applying unit 40*d* includes a switching means (not shown) which converts a DC high voltage into a high voltage having a pulse form (that is, AC voltage) by performing ON/OFF switching corresponding to the pulse signal, and outputting the high voltage having a pulse form. As the switching means, there may be a relay for a high voltage which can control switching by the unit of ms, or a semiconductor switching device which can control switching by the unit of μs.

In addition, the program controlling unit 40*b* is provided with a protecting means to prepare for case that excessive voltages or currents are applied or that arcing occurs. For example, the program controlling unit 40*b* detects currents fed back from the anode electrode 5, and if the detected currents are more than a preset limit current, the program controlling unit 40*b* outputs a pulse controlling signal for turning off a switching means of the high voltage applying unit, or stops a program. That is, the program controlling unit 40*b* prevents a high voltage from being applied to the anode electrode 5. In addition by controlling the power controlling unit 40*a* used in main-aging processing, the program controlling unit 40*b* outputs a control signal which stops a supply of a scan driving voltage.

Operations of the aging driving apparatus of a field emission display device according to the present invention constructed as above, will now be described divided into a pre-aging process and a main-aging process with reference to FIGS. 5 and 6.

Figure 5:
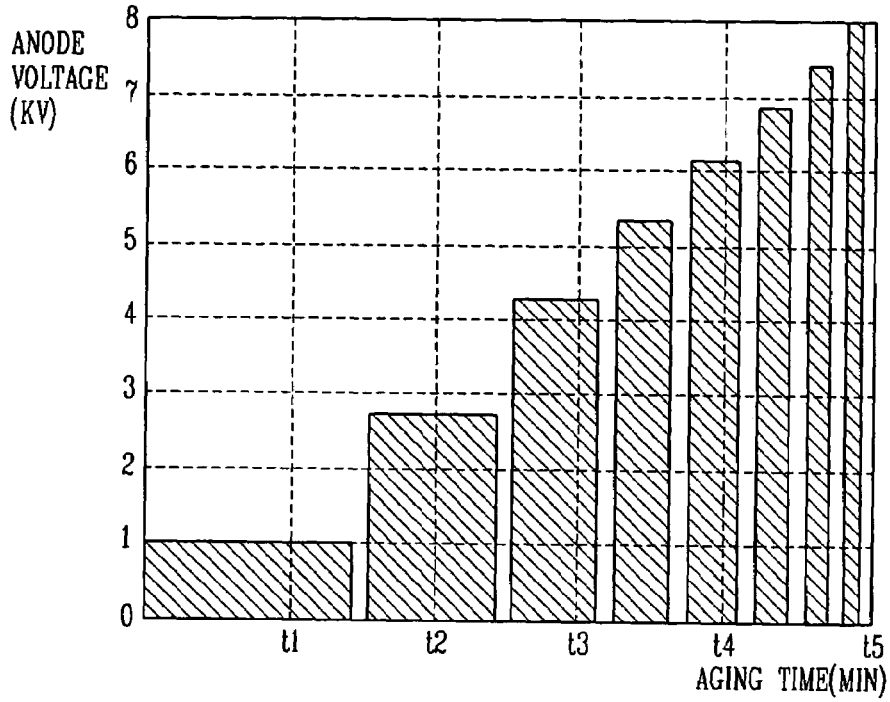
FIG. 5 is a graph illustrating a high voltage having a pulse form applied to an anode electrode over aging time in the present invention.

FIG. 5 is a graph illustrating a high voltage having a pulse form applied to an anode electrode over aging time in the present invention.

Figure 6:
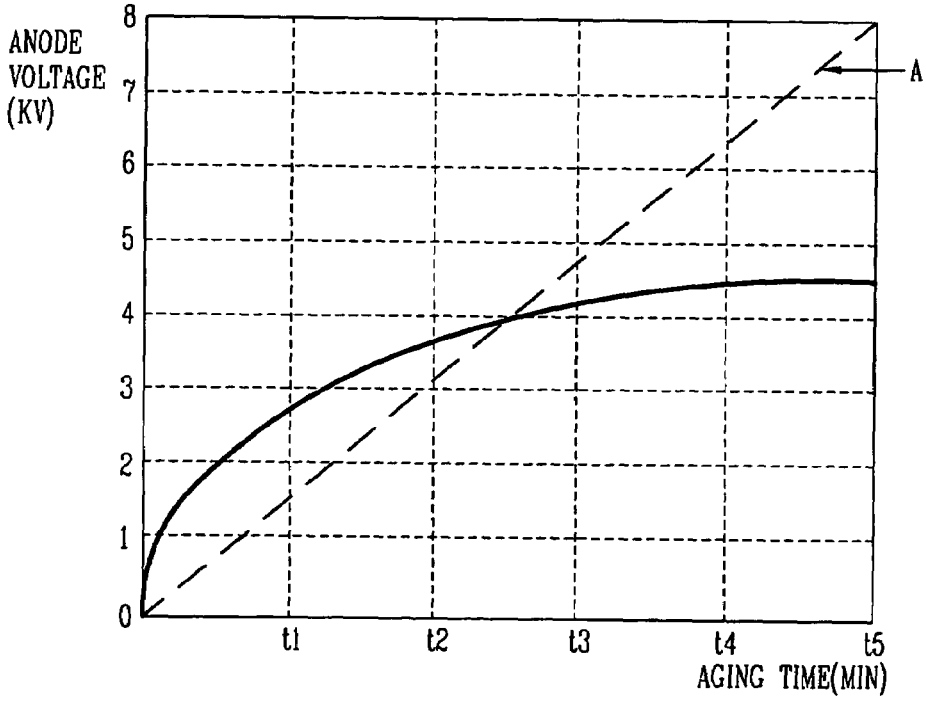
FIG. 6 is a graph for comparing an aging time with respect to a DC high voltage and a gradient in the present invention.

FIG. 6 is a graph for comparing an aging time with respect to a DC high voltage and a gradient in the present invention.

As shown in FIGS. 5 and 6, the pre-aging means a process of performing aging only with an anode voltage (Va) without emitting electrons, removing dangerous factors which may cause arcing, and the main-aging means a process of reducing possibilities of arcing which may be generated hereafter, by performing current aging by emitting electrons after the anode voltage (Va) has been supplied.

First, the pre-aging process will now be described.

When a DC high voltage is inputted to the switching means of the high voltage applying unit 40*e*, the program controlling unit 40*b* outputs a program controlling signal, and the pulse controlling unit 40*c* receives the program controlling signal and outputs a pulse controlling signal having corresponding frequency and duty cycle. At this time, a control value for actual programming and time-controlling is stored in a table form at an internal memory of the program controlling unit 40*b*, so that a profile of the present invention is operated. Accordingly, the program controlling unit 40*b* outputs a program controlling signal for controlling a voltage over time when a predetermined time elapses so that an output width of the oscillation unit can be changed. That is, the oscillation unit 40*c*1 receives a program controlling signal (in) outputted from the program controlling signal, and outputs a corresponding frequency. Then, the frequency-converting unit 40*c*2 receives the frequency outputted from the oscillation unit 40*c*1, converts the frequency into a predetermined frequency, and then outputs the converted frequency. In addition, the duty converting unit 40*c*4 receives a program controlling signal (in) outputted from the program controlling unit 40*b* and outputs a corresponding duty cycle. Accordingly, the logic circuit unit 40*c*3 receives data related to the converted frequency outputted from the frequency converted unit 40*c*2 and the duty cycle outputted from the duty converting unit 40*c*4, and outputs a predetermined pulse controlling signal (out).

Thereafter, the pulse generating unit 40*d* receives the pulse controlling signal outputted from the logic circuit unit 40*c*3 and outputs a corresponding pulse signal. That is, a pulse signal whose frequency and duty cycle are varied over time is outputted, and thus, by ON/OFF switching of the switching means of the high voltage applying unit 40*e*, as shown in FIG. 5, a high voltage having a pulse form (that is, AC high voltage) whose width is varied over time is applied to an anode electrode 5 of a panel 30.

For example, if a pulse having a certain frequency is outputted from the oscillation unit 40*c*1, the frequency converting unit 40*c*2 decreases the frequency outputted from the oscillating unit 40*c*1 by ½. And, the duty converting unit 40*c*4 detects a pulse at a rising edge point, and outputs a pulse with a width which is varied according to R, C values of the panel.

Therefore, in case of an initial stage of aging driving (or applying a low voltage), by applying a pulse whose width is widened in general to a circuit structure of a next block, energy is much supplied to a panel in whole. In case that a predetermined time elapses (or applying a high voltage), by applying a signal so that a width of a pulse is narrowed through programming or a timer circuit, small energy is applied to the panel.

For example, an AC high voltage having a form such as an ON-time of 16 ms and an OFF-time of 4 ms in case of a first pulse time and an ON-time of 10 ms and an OFF-time of 4 ms in case of a second pulse signal, is applied to the anode electrode 5. To be sure, the described pre-aging process is performed in a state of not being sealed, and contaminants generated during this process are exhausted by a vacuum pump.

When the pre-aging process is over, the program controlling unit 40*b* outputs a power controlling signal to the power controlling unit 40*a*, and the power controlling unit 40*a* receives a power controlling signal outputted from the program controlling unit 40*b*, and applies power to the scan driving unit 20, so that a main-aging process is performed. That is, by emitting electrons at the scan electrode 2 of the device, a current aging is performed. Contaminants knocked off through such a main aging is exhausted by a vacuum pump too.

Thereafter, when the abovementioned pre-aging and main-aging are all over, a high vacuum region is sealed.

Accordingly, unlike the convention art that contaminants are removed by using a contaminant absorbing material (getter), in the present invention, contaminants can be removed without using the contaminant absorbing material (getter).

As so far described, in the present invention, a DC voltage is applied and controlled by ON/OFF switching over time, and thus a high voltage having a pulse form whose width is varied is applied to an anode electrode, thereby performing aging. At this time, energy (voltage×pulse width) applied to a panel is controlled so that much energy is sufficiently applied to a panel under a low voltage, and small energy is applied to a panel under a high voltage by controlling a width of a pulse so as to be narrowed. Through such processes, aging is performed, thereby reducing a possibility of generation of arcing and thereby securing long lifetimes of a panel. In addition, in a supply of a pulse, aging is performed in a very short time by using small energy, so that a damage of a panel can be prevented, and an aging time can be much shortened. In addition, contaminants are removed by performing aging in each pre-aging process and main-aging process, so that lifetimes of a panel can be lengthened, and reliability of a product can be secured.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An aging driving apparatus of a field emission display comprising:

an aging driving controlling unit for gradually reducing a pulse width of a voltage which is applied to an anode electrode of a panel of the field emission display when gradually increasing the voltage, when performing an aging of the field emission display.

2. The apparatus of claim 1, wherein the aging driving controlling unit applies a pulse voltage whose width is varied in response to a DC high voltage, which gradually increases up to a predetermined maximum voltage, to the anode electrode, and then drives the panel by applying power to a scan driving unit.

3. The apparatus of claim 1, wherein the aging driving controlling unit comprises:

a power controlling unit for applying power to a scan driving unit by an external power controlling signal;

a pulse controlling unit receiving an external program controlling signal, and outputting a pulse controlling signal corresponding to a frequency and a duty cycle which are varied over time;

a pulse generating unit receiving the pulse controlling signal outputted from the pulse controlling unit, and outputting a corresponding pulse signal;

a high voltage applying unit receiving the pulse signal from the pulse generating unit, converting a high voltage into a high voltage having a pulse form, and applying the high voltage having a pulse form to the anode electrode; and a program controlling unit for outputting a program controlling signal to the pulse controlling unit and outputting a power controlling signal to the power controlling unit.

4. The apparatus of claim 3, wherein the program controlling unit and the power controlling unit, the program controlling unit and the pulse generating unit, and the program controlling unit and the high voltage applying unit are interconnected by a general purpose interface bus.

5. An aging driving apparatus of a field emission display comprising:

an aging driving controlling unit for gradually reducing a pulse width of a voltage which is applied to an anode electrode of a panel of the field emission display when gradually increasing the voltage, when performing an aging of the field emission display wherein the aging driving controlling unit comprises:

a power controlling unit for applying power to a scan driving unit by an external power controlling signal;

a pulse controlling unit receiving an external program controlling signal. and outputting a pulse controlling signal corresponding to a frequency and a duty cycle which are varied over time:

a pulse generating unit receiving the pulse controlling signal outputted from the pulse controlling unit, and outputting a corresponding pulse signal:

a high voltage applying unit receiving the pulse signal from the pulse generating unit, converting a high voltage into a high voltage having a pulse form, and applying the high voltage having a pulse form to the anode electrode; and a program controlling unit for outputting a program controlling signal to the pulse controlling unit and outputting a power controlling signal to the power controlling unit, and wherein the pulse controlling unit comprises:

an oscillation unit receiving a program controlling signal from the program controlling unit, and outputting a predetermined frequency;

a frequency converting unit receiving the predetermined frequency from the oscillation unit, converting the frequency and outputting the converted frequency;

a duty converting unit receiving a program controlling signal from the program controlling unit, and outputting a corresponding duty cycle; and a logic circuit unit receiving the converted frequency from the frequency converting unit and the duty cycle from the duty converting unit, and outputting a pulse controlling signal to the pulse generating unit.

6. The apparatus of claim 5, wherein the program controlling unit outputs a program controlling signal for controlling a voltage over time if predetermined time elapses, and changes an output width of the oscillation unit.

7. The apparatus of claim 3, wherein the program controlling unit comprises an internal memory in which a control value for programming and time-controlling is stored in a table form.

8. The apparatus of claim 3, wherein the high voltage applying unit comprises a switching means for converting a DC high voltage into a high voltage having a pulse form by performing ON/OFF switching corresponding to the pulse signal, and outputting the high voltage having a pulse form.

9. The apparatus of claim 8, wherein the switching means is a relay for a high voltage which can control switching by the unit of ms, and a semiconductor switch device which can control switching by the unit of μs.

10. The apparatus of claim 3, wherein the program controlling unit detects a current fed back from the anode electrode, and if the detected currents are more than a preset limit current, the program controlling unit outputs a pulse controlling signal for turning off the high voltage applying unit or outputs a control signal for stopping a program.

11. The apparatus of claim 3, wherein the program controlling unit controls the power controlling unit, and outputs a control signal for stopping a supply of a scan driving voltage.

12. The apparatus of claim 1, further comprising a data driving unit for outputting a timing controlling signal and a data pulse.

13. The apparatus of claim 12, wherein the scan driving unit receives a data signal and a clock signal which are inputted from the outside by a timing controlling signal outputted from the data driving unit, and outputs a scan pulse.

14. An aging driving method of a field emission display comprising:

gradually reducing a pulse width of a voltage which is applied to an anode electrode of a panel of the field emission display when gradually increasing the voltage, when performing an aging of the field emission display.

15. The method of claim 14, wherein energy is supplied to a panel, by widening a width of a pulse at an initial state of driving aging (or in applying a low voltage), and by applying a signal so that a width of a pulse is narrowed through programming and a timer circuit when predetermined time elapses.

16. The method of claim 14, wherein the high voltage having a pulse form is generated by ON/OFF switching of a switching means which receives a pulse signal whose frequency and duty cycle are varied over time.

17. The method of claim 16, wherein the pulse signal is generated based on a control value for programming and time-controlling, which is stored in a table form at an internal memory.

18. The method of claim 14, further comprising performing main-aging by controlling a voltage applied to scan driving unit.

19. The method of claim 18, wherein the main aging is that current aging is performed by emitting electrons from a scan electron.

20. The method of claim 18, wherein contaminants generated during performing the pre-aging and the main-aging are exhausted by a vacuum pump in a vacuum state.

* * * * *